US008998650B2

(12) United States Patent
Ku et al.

(10) Patent No.: US 8,998,650 B2
(45) Date of Patent: Apr. 7, 2015

(54) CONNECTOR WITH FPCB PIN MODULE

(71) Applicant: YFC-BONEAGLE Electric Co., Ltd., Taoyuan County (TW)

(72) Inventors: Ying-Ming Ku, Taoyuan County (TW); Chun-Chieh Chen, Taoyuan County (TW)

(73) Assignee: YFC-BONEAGLE Electric Co., Ltd., Taoyuan County (TW)

( * ) Notice: Subject to any disclaimer, the term of this patent is extended or adjusted under 35 U.S.C. 154(b) by 196 days.

(21) Appl. No.: 13/865,661

(22) Filed: Apr. 18, 2013

(65) Prior Publication Data

US 2014/0315444 A1 Oct. 23, 2014

(51) Int. Cl.
*H01R 24/64* (2011.01)

(52) U.S. Cl.
CPC ..... *H01R 24/64* (2013.01)

(58) Field of Classification Search
CPC ..... H01R 24/64
USPC ..... 439/676–677, 344, 941, 79, 76.1, 248, 439/955, 217–224, 73
See application file for complete search history.

(56) References Cited

U.S. PATENT DOCUMENTS

| | | | | |
|---|---|---|---|---|
| 7,828,603 | B1 * | 11/2010 | Ku et al. | 439/676 |
| 7,837,511 | B2 * | 11/2010 | Hsu | 439/669 |
| 7,837,513 | B2 * | 11/2010 | Millette et al. | 439/676 |
| 7,985,101 | B2 * | 7/2011 | Fitzpatrick | 439/676 |
| 8,128,436 | B2 * | 3/2012 | Bopp et al. | 439/676 |

* cited by examiner

*Primary Examiner* — Edwin A. Leon
(74) *Attorney, Agent, or Firm* — Chun-Ming Shih; HDLS IPR Services

(57) ABSTRACT

A connector includes a front seat, an FPCB pin module, an FPCB, a plurality of terminals and a flexible support. The front seat has a socket and a room for receiving the socket. The flexible printed circuit board (FPCB) pin module is received in the room. The FPCB has a fixing portion, a connecting portion bendingly extending from an edge of the fixing portion and a terminal insertion portion extending from another edge of the fixing portion and corresponding to the socket. The terminals pass through and are fixed on the terminal insertion portion. The flexible support is attached on the fixing portion and the connecting portion for supporting the connecting portion.

9 Claims, 7 Drawing Sheets

CONNECTOR WITH FPCB PIN MODULE

BACKGROUND OF THE INVENTION

1. Technical Field

The present invention relates to connectors, particularly to a connector with an FPCB pin module.

2. Related Art

A convention Ethernet connector, such as an RJ45 connector, is formed by a plastic socket with an opening. A plurality of V-shaped terminals are arranged in the opening and are fixed by a terminal frame. A hard printed circuit board is used to connect piercing terminals. Some pins or terminals are connected by soldering.

However, the soldering process for terminals, hard PCB and terminals is so complicated and uneconomical. Additionally, the soldering points will make an antenna effect to interfere with data transmission, such as distortion, delay and crossover.

SUMMARY OF THE INVENTION

An object of the invention is to provide a connector with an FPCB pin module, which can improve assembling efficiency of connectors and performance of data transmission.

To accomplish the above object, the connector of the invention includes a front seat, an FPCB pin module, an FPCB, a plurality of terminals and a flexible support. The front seat has a socket and a room for receiving the socket. The flexible printed circuit board (FPCB) pin module is received in the room. The FPCB has a fixing portion, a connecting portion bendingly extending from an edge of the fixing portion and a terminal insertion portion extending from another edge of the fixing portion and corresponding to the socket. The terminals pass through and are fixed on the terminal insertion portion. The flexible support is attached on the fixing portion and the connecting portion for supporting the connecting portion.

Advantages of the invention are listed as follows:

1. Conventional V-shaped terminals can be replaced with the FPCB. The terminals are directly fixed on the FPCB so that a soldering process of pins and terminals can be saved and the antenna effect can be avoided.
2. By replacing conventional V-shaped pins with FPCB 3, the wiring arrangement can be balanced. The connecting portion 32 and a signal wire (not shown, disposed on the FPCB 3) are the same in width, impedance matching can be obtained. As a result, signal delay and crossover can be reduced.
3. The FPCB can be reinforced by the flexible support, so that the connecting portion 32 can keep a good restoration ability.
4. Because the FPCB is thinner than a hard PCB, the FPCB can be bendable and applied in a limited space.

DETAILED DESCRIPTION OF THE INVENTION

Figure 1:
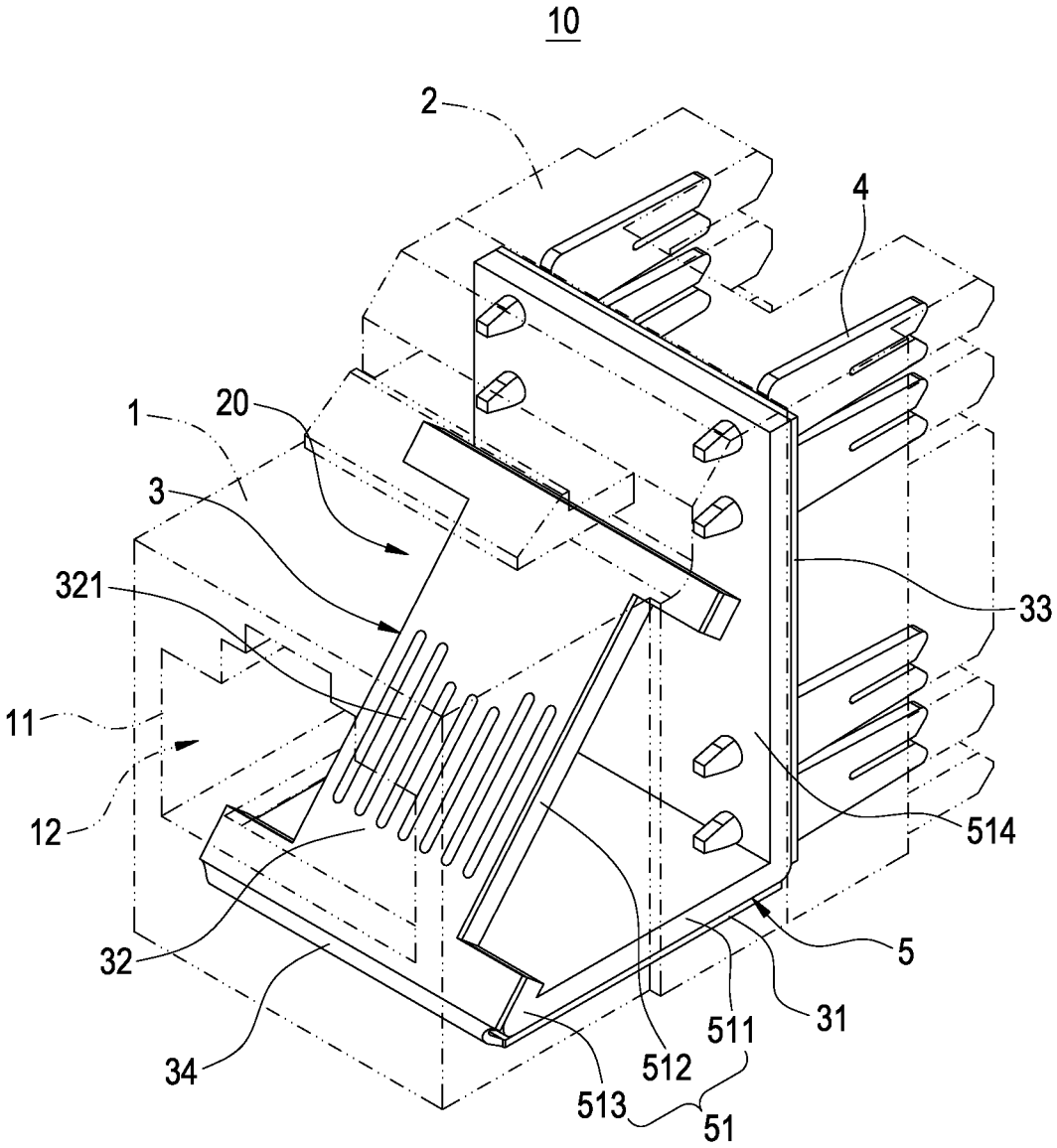
FIG. 1 is a perspective view of the invention.
Figure 2:
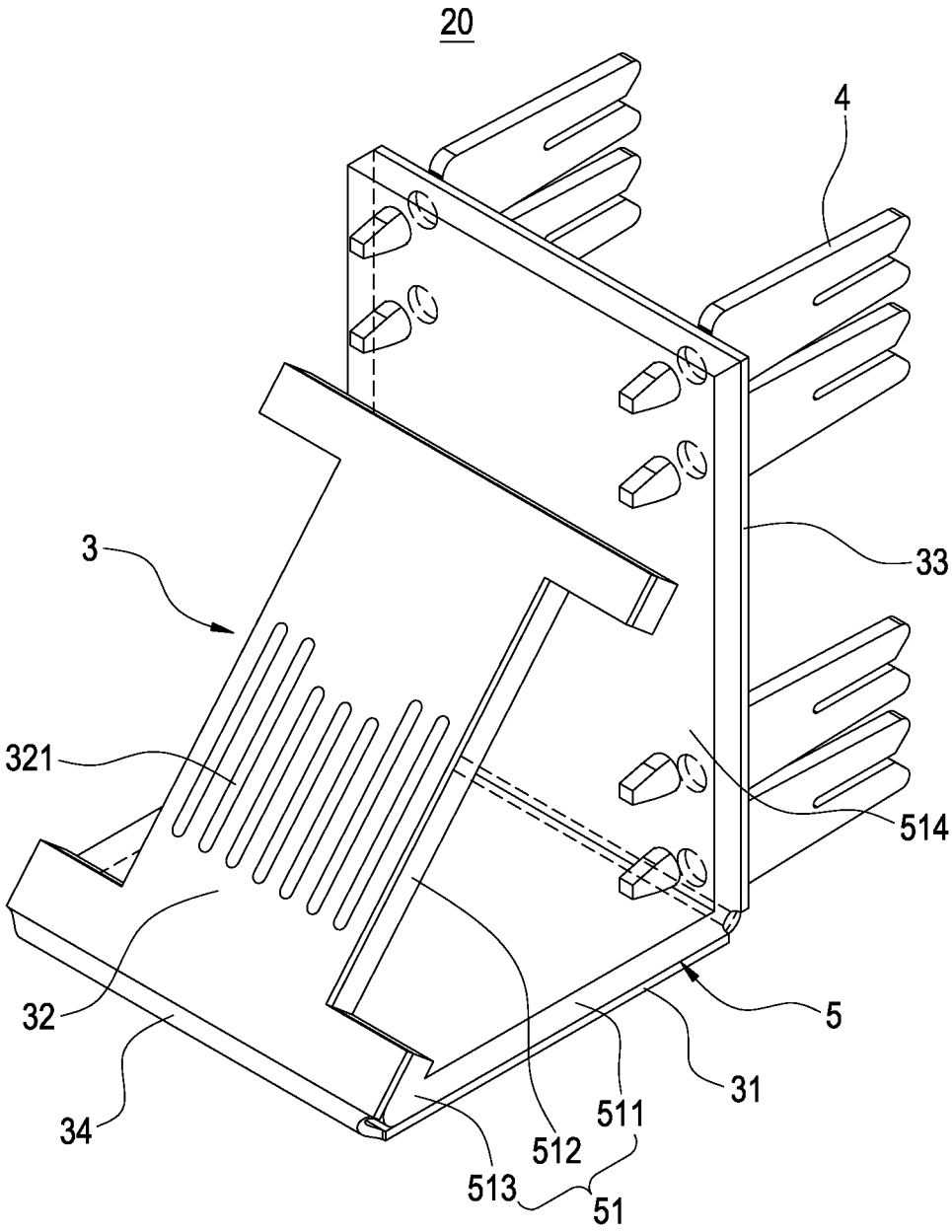
FIG. 2 is a perspective view of the FPCB module of the invention.
Figure 3:
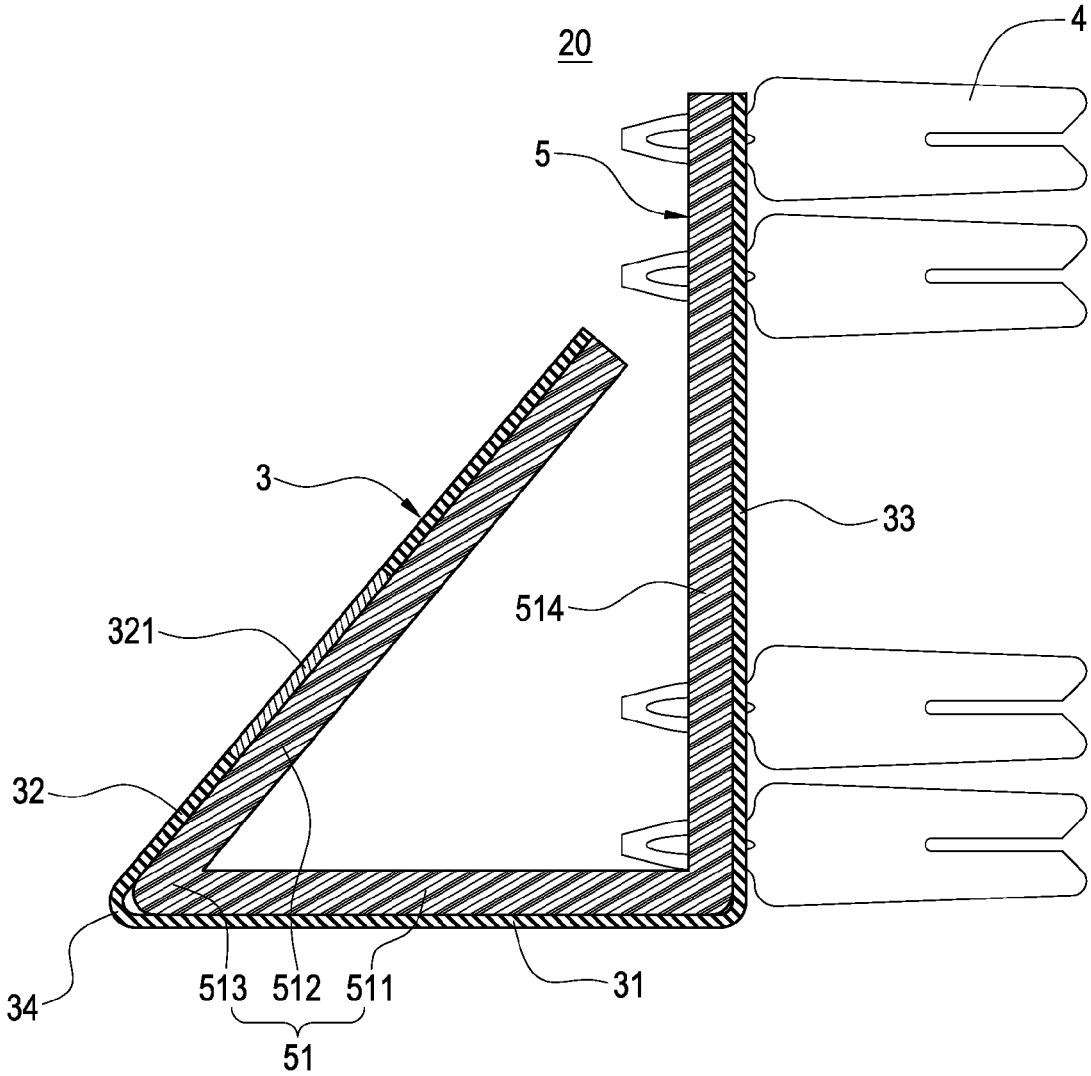
FIG. 3 is a sectional view of the FPCB module of the invention.

Please refer to FIGS. 1-3. The connector 10 of the invention includes a front seat 1 and a flexible printed circuit board (FPCB) pin module 20. The FPCB pin module 20 includes an FPCB 3, a plurality of terminals 4 and a flexible support 5.

The connector 10 can be, but not limited to, an RJ45 connector. The front seat 1 is formed with a socket 11 and a room 12 for receiving the socket 11. The connector 10 further includes a rear seat 2 located behind the front seat 1. The rear seat 2 may be omitted according to actual requirements.

The flexible circuit board (FPCB) pin module 20 is received in the room.

The FPCB 3 has a fixing portion 31, a connecting portion 32 bendingly extending from an edge of the fixing portion 31 and a terminal insertion portion 33 extending from another edge of the fixing portion 31 and corresponding to the socket 11. The connecting portion 32 aslope to the fixing portion 31, i.e., a bend portion 34 is formed between the fixing portion 31 and the connecting portion 32. The terminal insertion portion 33 is perpendicular to the fixing portion 31. The front side of the connecting portion 32 is provided with signal connection areas 321, so that the FPCB 3 can replace conventional V-shaped terminals.

The terminals 4 pass through and are fixed on the terminal insertion portion 33. The terminals 4 are separately connected to the signal connection areas 321 through the FPCB 3. The terminals 4 are eight in number and are separately located at four corners of the terminal insertion portion 33.

The flexible support is a plastic sheet and attached on the fixing portion 31 and the connecting portion 32 for supporting the connecting portion. The flexible support is a V-shaped sheet 51 composed of a horizontal section 511, a slant section 512 and a bend section 513 therebetween. The horizontal section 511, slant section 512 and bend section 513 are attached on the fixing portion 31, connecting portion 32 and bend portion 34, respectively. Additionally, the horizontal section 511 is further extended with a vertical section 514 attached on the terminal insertion portion 33.

Thus, conventional V-shaped terminals can be replaced with the FPCB 3. The terminals 4 are directly fixed on the FPCB 3 so that a soldering process of pins and terminals can be saved and the antenna effect can be avoided.

By replacing conventional V-shaped pins with FPCB 3, the wiring arrangement can be balanced. The connecting portion 32 and a signal wire (not shown, disposed on the FPCB 3) are the same in width, impedance matching can be obtained. As a result, signal delay and crossover can be reduced.

The FPCB 3 can be reinforced by the flexible support 5, so that the connecting portion 32 can keep a good restoration ability.

Figure 4:
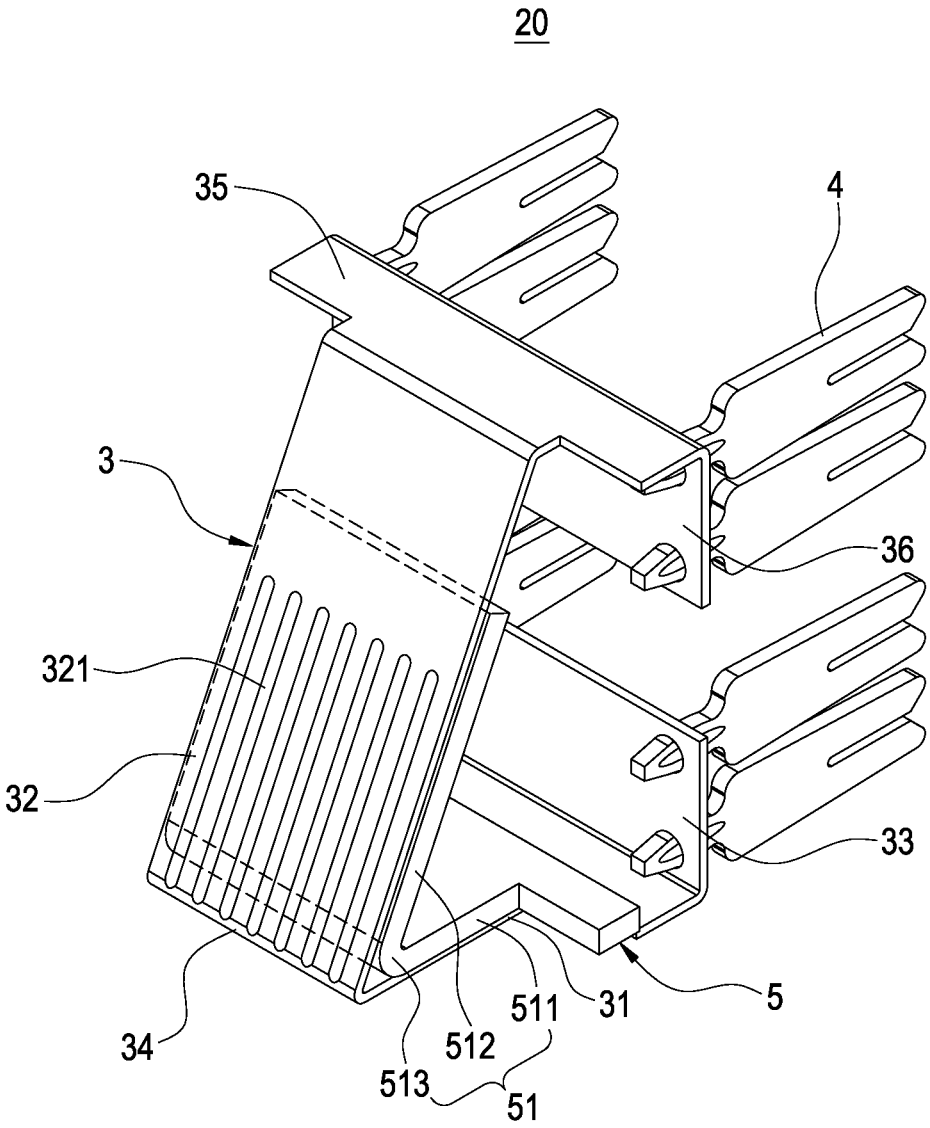
FIG. 4 is a perspective view of another embodiment of the FPCB module.
Figure 5:
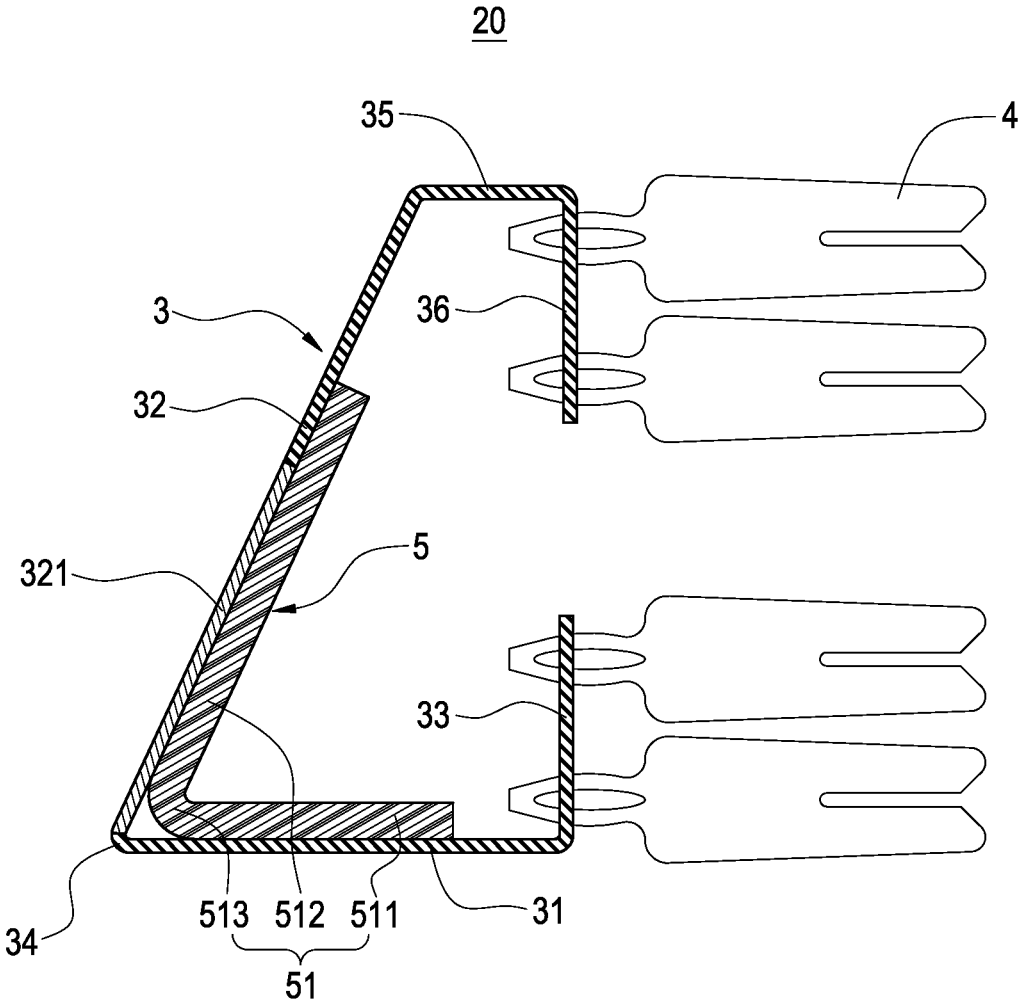
FIG. 5 is a sectional view of another embodiment of the FPCB module.

FIGS. 4-5 show another embodiment of the invention. The top end of the connecting portion 32 is extended with an extension portion 35. The extension portion 35 is parallel to the fixing portion 31 and is extended with a vertical terminal inserting portion 36. Four of the terminals 4 are fixed on the terminal insertion portion 33 and the other four are fixed on the terminal inserting portion 36. This allows the FPCB pin module 20 to be applied in a 180° network socket (Keystone Jack).

Figure 6:
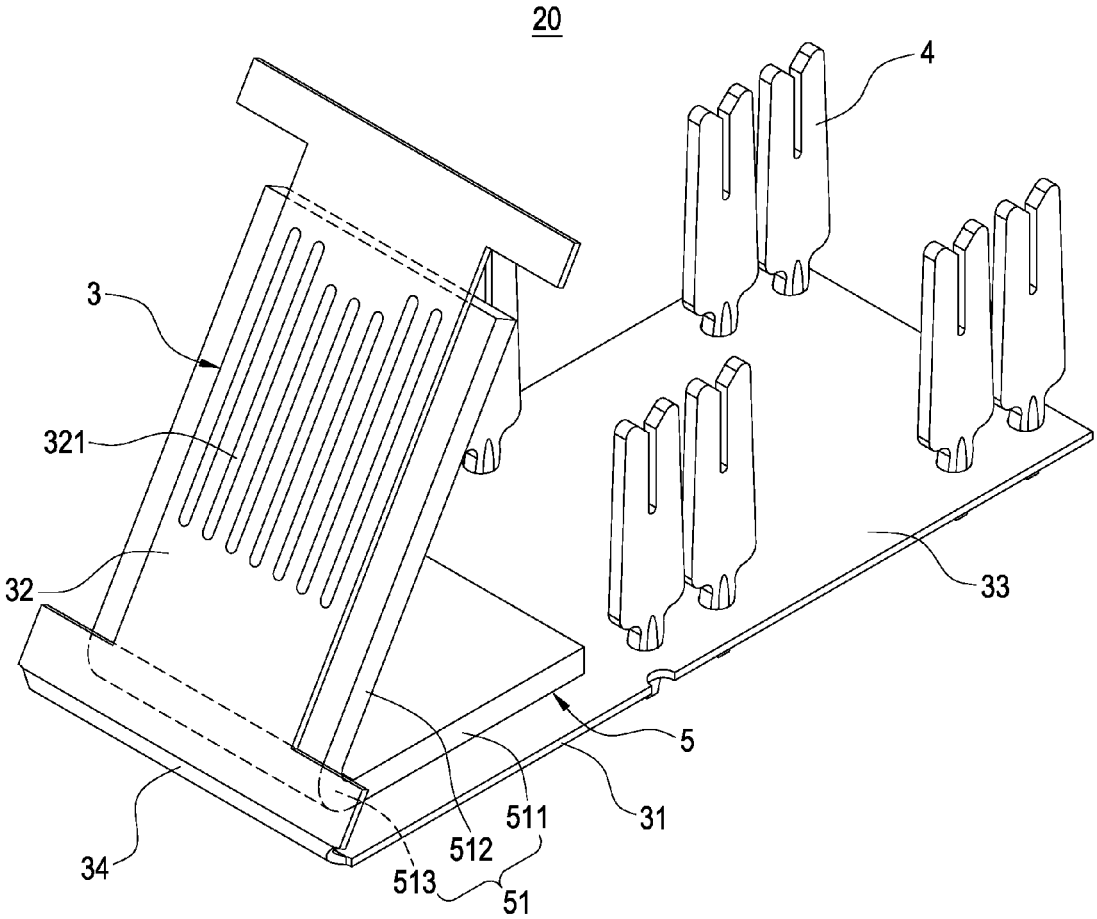
FIG. 6 is a perspective view of still another embodiment of the FPCB module.
Figure 7:
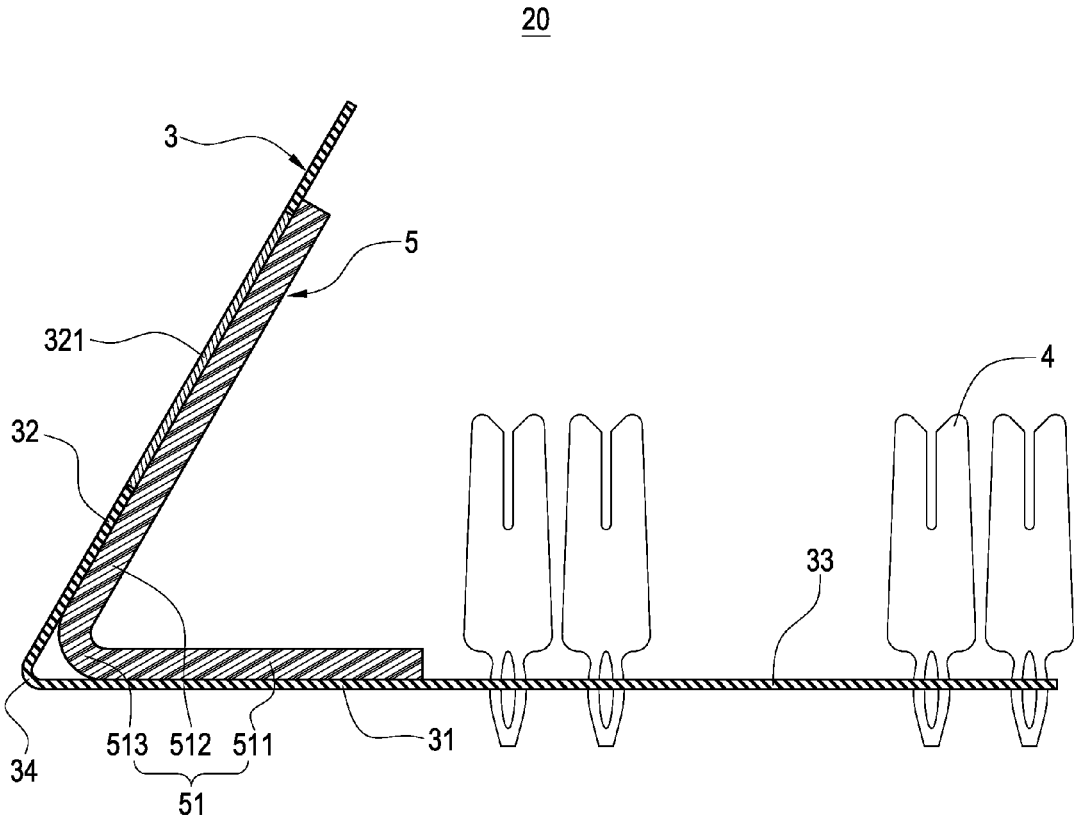
FIG. 7 is a sectional view of still another embodiment of the FPCB module.

FIGS. 6-7 shows still another embodiment of the invention. As shown, the terminal insertion portion 33 is coplanar with the fixing portion 31. The terminals 4 are fixed on the terminal insertion portion 33. This allows the FPCB pin module 20 to be applied in a 90° network socket (Keystone Jack).

Because the FPCB 3 is thinner than a hard PCB, the FPCB 3 can be bendable and applied in a limited space.

While the forgoing is directed to preferred embodiments of the present invention, other and further embodiments of the invention may be devised without departing from the basic scope thereof. As such, the appropriate scope of the invention is to be determined according to the claims.

What is claimed is:

1. A connector comprising:

a front seat, having a socket and a room for receiving the socket; and a flexible printed circuit board (FPCB) pin module, received in the room, and comprising:

an FPCB, having a fixing portion, a connecting portion bendingly extending from an edge of the fixing portion and a terminal insertion portion extending from another edge of the fixing portion and corresponding to the socket;

a plurality of terminals, passing through and fixed on the terminal insertion portion; and a flexible support, attached on the fixing portion and the connecting portion for supporting the connecting portion, wherein the connecting portion is aslope to the fixing portion, and wherein a bend portion is formed between the fixing portion and the connecting portion, the flexible support is a V-shaped sheet composed of a horizontal section, a slant section and a bend section therebetween, the horizontal section, and the slant section and the bend section are attached on the fixing portion, the connecting portion and the bend portion, respectively.

2. The connector of claim 1, wherein the terminal insertion portion is perpendicular to the fixing portion, and the horizontal section is further extended with a vertical section attached on the terminal insertion portion.

3. The connector of claim 2, wherein the terminals are eight in number, and the terminals are separately fixed at four corners of the terminal insertion portion.

4. The connector of claim 1, wherein the terminal insertion portion is perpendicular to the fixing portion, and a top end of the connecting portion is extended with an extension portion, and the extension portion is parallel to the fixing portion and is extended with a vertical terminal inserting portion.

5. The connector of claim 4, wherein the terminals are eight in number, and four of the terminals are fixed on the terminal insertion portion and another four are fixed on the terminal inserting portion.

6. The connector of claim 1, wherein the terminal insertion portion is coplanar with the fixing portion, the terminals are eight in number and fixed on the terminal insertion portion.

7. The connector of claim 1, wherein a front side of the connecting portion is provided with signal connection areas.

8. The connector of claim 7, wherein the terminals are separately connected to the signal connection areas through the FPCB.

9. The connector of claim 1, further comprising a rear seat connected behind the front seat.

* * * * *